US005582339A

United States Patent [19]

Focke et al.

[11] Patent Number: 5,582,339

[45] Date of Patent: Dec. 10, 1996

[54] APPARATUS FOR STORING A CONTINUOUS WEB OF MATERIAL MADE FROM PACKAGING MATERIAL

[75] Inventors: Heinz Focke; Oskar Balmer, both of Verden, Germany

[73] Assignee: Focke & Co. (GmbH & Co.), Verden, Germany

[21] Appl. No.: 440,255

[22] Filed: May 12, 1995

[30] Foreign Application Priority Data

May 17, 1994 [DE] Germany ..... 44 17 176.5

[51] Int. Cl.[6] ..... B65H 20/24; B65H 20/34; B65H 26/04

[52] U.S. Cl. ..... 226/21; 226/44; 226/119

[58] Field of Search ..... 226/21, 22, 23, 226/44, 119; 248/581, 618

[56] References Cited

U.S. PATENT DOCUMENTS

| | | | |
|---|---|---|---|
| 3,032,248 | 5/1962 | Morrow . | |
| 3,109,572 | 11/1963 | Herr . | |
| 3,233,808 | 2/1966 | Alexeff et al. . | |
| 3,596,817 | 8/1971 | Morse et al. | 226/21 |
| 3,998,368 | 12/1976 | Hackey | 226/44 |
| 4,533,109 | 8/1985 | Delam | 248/618 |
| 4,606,486 | 8/1986 | Brunner et al. | 226/21 |
| 4,690,349 | 9/1987 | Yamaguchi | 226/119 |
| 4,856,692 | 8/1989 | Harper | 226/119 |
| 4,915,282 | 4/1990 | Martin et al. | 226/119 |
| 5,316,230 | 5/1994 | Focke et al. . | |

FOREIGN PATENT DOCUMENTS

| | | |
|---|---|---|
| 395029 | 10/1990 | European Pat. Off. . |
| 3727339 | 3/1989 | United Kingdom . |

*Primary Examiner*—Daniel P. Stodola
*Assistant Examiner*—Matthew A. Kaness
*Attorney, Agent, or Firm*—Sughrue, Mion, Zinn, Macpeak & Seas

[57] ABSTRACT

An apparatus including a material accumulator (10) which is used, in conjunction with a packaging machine, for temporarily storing a continuous web (11) of material. Accurate operation of the material accumulator (11) is achieved by pivoting at least one deflecting roller (12, 13) of the material accumulator (10) about a rotational axis (38), which is directed transversely relative to the longitudinal axis of the web (11), to adjust the relative position of the web of material.

23 Claims, 3 Drawing Sheets

APPARATUS FOR STORING A CONTINUOUS WEB OF MATERIAL MADE FROM PACKAGING MATERIAL

BACKGROUND OF THE INVENTION

The invention relates to an apparatus for storing a continuous web of material made from packaging material, especially paper or foil, having a web of material accumulator comprising two groups of deflecting rollers which are movable relatively to one another and on which the web of material is guided in loops.

Web of material accumulators are used for example in conjunction with packaging machines for temporarily storing a continuous web of material. Conventionally, a first group of deflecting rollers is moved relatively to a second group of deflecting rollers for increasing or reducing the contents of the accumulator. Fluctuations in the operation of the packaging machine can be compensated in this manner. Web of material accumulators are often used in conjunction with a device for joining a running-off web of material to a new web of material in connection with the exchange of a reel. The content of the accumulator of the web of material accumulator is increased before joining the webs of material, so that the web of material can be withdrawn from the web of material accumulator during the exchange of the reels (DE-41 07 254 A1).

SUMMARY OF THE INVENTION

The invention relates to increasing the possibilities for using the web of material accumulator. The object of the invention is to provide an apparatus which ensures a more accurate operation of the web of material accumulator.

To attain this object, the apparatus is characterized in that at least one of the deflecting rollers of the web of material accumulator can be pivoted about an axis which is transverse relative to the longitudinal axis of the web of material for adjusting the relative position of the web of material. Preferably, the axis extends in a central longitudinal plane of the web of material.

The web of material can thus be stored and, at the same time, adjusted with respect to its relative position by means of the apparatus according to the invention. Additional members for adjusting the relative position of the web of material are not required. The constructive effort and the required space of the apparatus according to the invention are thus reduced to a minimum.

Expediently, the web of material accumulator is provided with two upright guide rods arranged parallel to one another. A holder is arranged at the upper end of the guide rods for the first group of deflecting rollers. A carrier for the second group of deflecting rollers is slidably guided on the guide rods in a vertical plane. TIle tension of the web of material can thus be kept constant as the result of the carrier's own weight. In such a web of material accumulator, the adjustment of the relative position of the web of material can advantageously be effectuated by pivoting the holder and/or the carrier. It is particularly advantageous if the web of material accumulator is pivotable as a whole, for example about an axis of rotation which extends in a central longitudinal plane of the web of material.

Further features of the invention become apparent from a study of the claims and, in particular, relate to the design of the web of material accumulator, and to sensors for determining the filling level of the same.

The invention is explained in more detail hereinbelow with reference to the drawings. In these:

DESCRIPTION OF PREFERRED EMBODIMENTS

Figure 1:
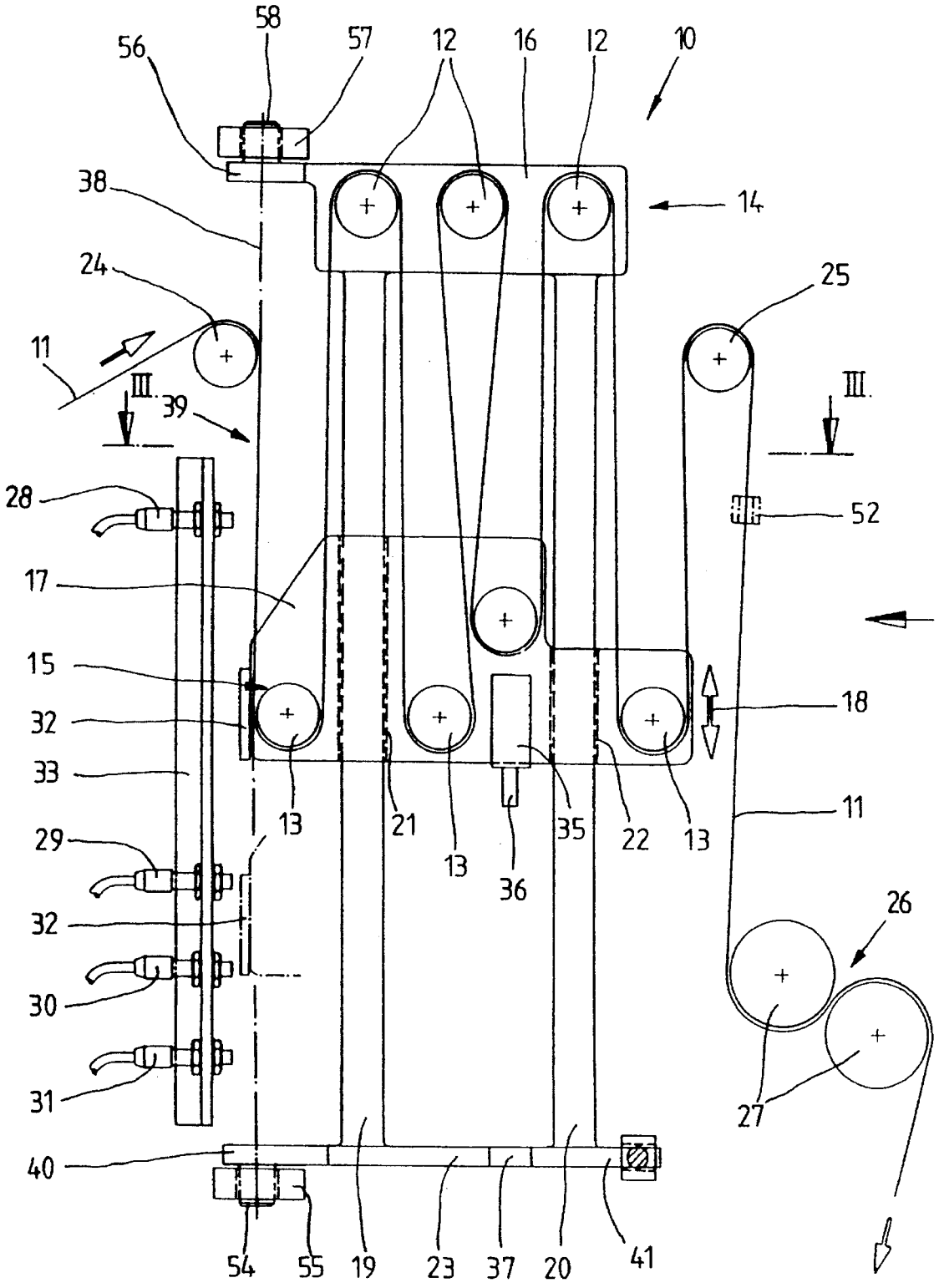
FIG. 1 shows a side view of an apparatus for storing a web of material.

Web of material accumulators 10 are used in conjunction with packaging machines for temporarily storing a continuous web of material 11. In the web of material accumulator 10, the web of material is guided in loops over deflecting rollers 12 and 13. The respective deflecting rollers are combined to form a group 14, 15 of deflecting rollers 12, 13. The first group 14 of deflecting rollers 12 is arranged on a holder 16 so as to be freely rotatable. The deflecting rollers 12 are mounted in the holder 16 and project therefrom on one side.

The other group 15 of deflecting rollers 13 is also arranged so as to be freely rotatable on a carrier 17 which is movable relative to the holder 16. The deflecting rollers, on their part, are mounted on the carrier 17 and project therefrom on one side.

As indicated by the double arrow 18, the carrier 17 is slideably arranged on two upright guide rods 19, 20 which are arranged parallel to one another. To this end, the carrier 17 is provided with two bores 21, 22 arranged at a distance from one another through which the carrier 17 is guided on the guide rods 19, 20. The tension of the web of material is defined by the gravity of the carrier 17.

The guide rods 19, 20 are connected to one another at their upper ends by means of the holder 16 and, on the opposite side, by means of a crosspiece 23. For this purpose, the holder 16 and the crosspiece 23 are fixedly connected to the guide rods 19, 20. The latter are thus arranged at a fixed distance from one another.

The deflection rollers 24 and 25 are assigned to the input and output side of the web of material accumulator 10, respectively, the deflecting rollers 24, 25 being arranged at a common level. Adjoining the output deflecting roller 25, the web of material 11 is guided around a pair of drawing rollers 26 in a Z-shaped manner. At least one of the two drawing rollers 27 is drivable so that the web of material 11 is transported through the pair of drawing rollers at a constant speed.

Figure 3:
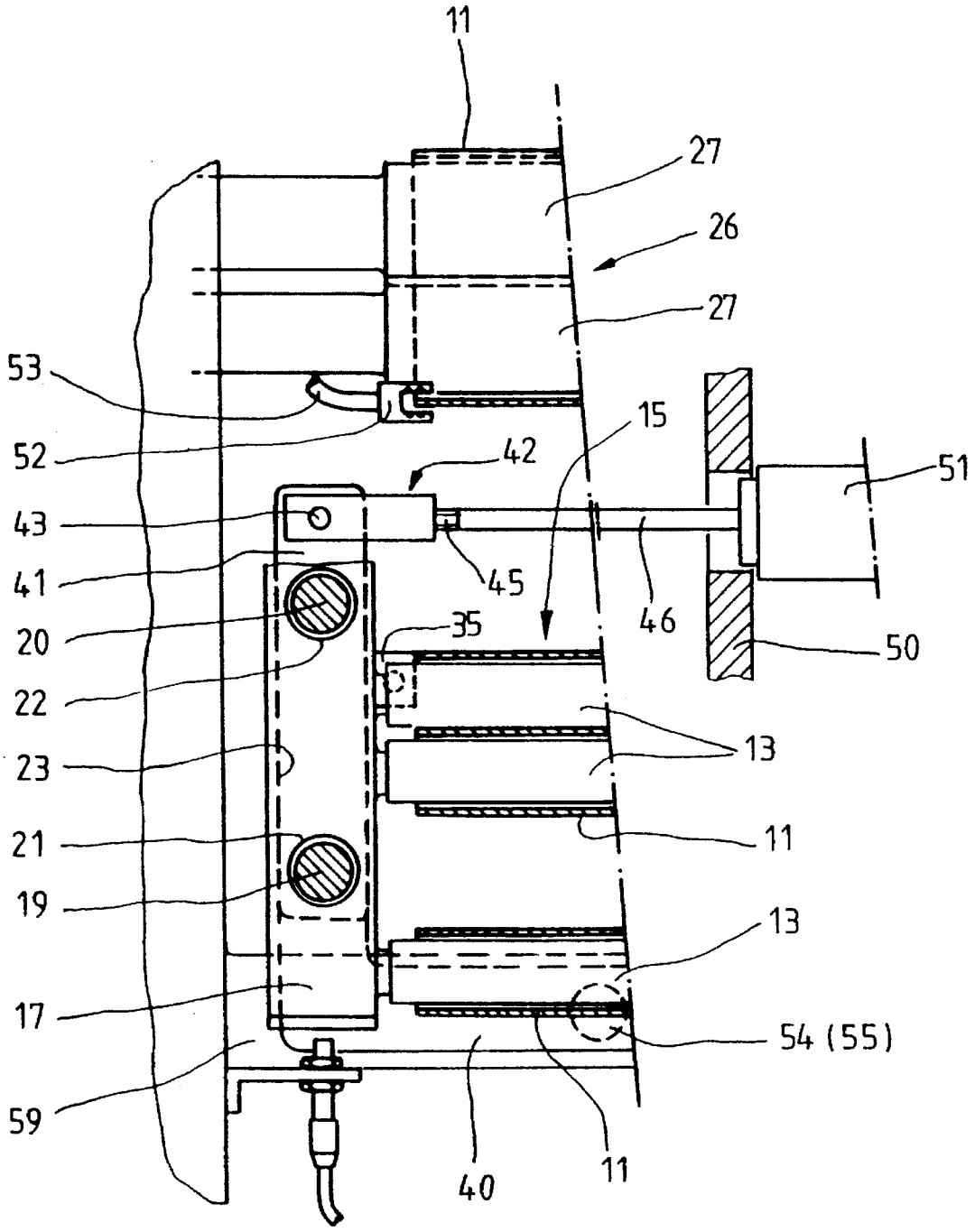
FIG. 3 shows the apparatus according to FIG. 1 in a section taken along the plane III—III.

Furthermore, the web of material accumulator 10 is assigned sensors 28, 29, 30, 31. These sensors 28 to 31 serve for controlling the filling level of the web of material accumulator 10, and for controlling the feed and discharge rate of the web of material 11 to or from the web of material accumulator 10. The sensors 28 to 31, in the present case, take the form of inductive detectors which interact with a plate 32 on the carrier 17. The plate 32 is made from a magnetizable material. The sensors 28 to 31 are arranged on a bracket 33 and fixedly connected to the machine stand 34 by means of said bracket 33 (FIG. 3).

The sensors 28 to 31 operate as follows:

The web of material accumulator is in the normal operating position if the carrier 17 and thus the plate 32 is situated between the sensor 28 and the sensor 29. The distance between sensor 28 and sensor 29 thus corresponds to the fluctuation range of the position of the carrier 17.

If the sensor 28 detects the presence of the plate 32, more web of material 11 has been discharged from the web of material accumulator 10 than was fed thereto. In this case, at least one processing station for the web of material 11, or the pair of drawing rollers 26, is stopped. However, it may also be sensible to stop the entire system as a reaction to a signal from sensor 28, in order to check the system for operative failures.

If only the sensor 29 is triggered, more material has been fed to the web of material accumulator 10 than was discharged therefrom. In this case, the feed rate of the web of material is reduced. If the carrier 17 still keeps lowering, sensor 29 and sensor 30 are also triggered. In this case, the feed of the web of material 11 to the web of material accumulator 10 is stopped altogether. As can be seen from FIG. 1, the distance between the sensors 29 and 30 corresponds approximately to the length of the plate 32.

Should the web of material tear off, the carrier 17 lowers onto the crosspiece 23. This is detected by the sensor 31 and the entire system is stopped.

In order to buffer the impact of the carrier 17 on the crosspiece 23, for example if the web of material 11 tears off, a shock absorber 35 is arranged on the carrier 17. A ram 36 of the shock absorber 35 rests on the integral nose 37 of the crosspiece 23.

For adjusting the relative position of the web of material 11, the web of material accumulator 10 is pivotably arranged on the machine stand 34. In particular, the crosspiece 23, and thus the web of material accumulator 10, can be pivoted about an axis of rotation 38 which extends in a central longitudinal plane of the web of material 11 according to FIG. 1, and, at the same time, in the plane of the incoming piece of web 39 of the web of material 11. The piece of web 39 is defined by the arrangement of the deflecting roller 24 on the input side and the one of the deflecting rollers 13 which is within the web of material accumulator 10 in the conveying direction. Preferably, the axis of rotation 38 furthermore extends parallel to the direction of motion of the carrier 17 along the guide rods 19, 20.

For the accommodation of a bearing, the crosspiece 23 extends up to a lateral region of the axis of rotation 38 and has a transversely directed leg 40 there. This leg 40 is, coaxially relative to the axis of rotation 38, provided with a downwardly directed bearing bolt 54, the bearing bolt 54 being accommodated in a pivot bearing 55 arranged below the leg. Similar to the design and arrangement of the crosspiece described hereinabove, the upper holder 16 is provided with a transversely directed leg 56 which carries a bearing bolt 58 rotating in a bearing 57.

The bearings 55 and 57 are positioned in cantilever arms 59, 60. These cantilever arms 59, 60 are assigned to the machine stand 34 and extend approximately parallel to the legs 40, 56.

The crosspiece 23 has an extension 41 at the end opposite of the guide rod 19 or the leg 40. With this extension 41, the crosspiece 23 projects beyond the region of the guide rod 20. A screw drive engages with the end of the extension 41, which is constructed as follows.

A fork-shaped spindle nut 42 is arranged on the extension 41. The spindle nut 42 is articulated to the extension 41 of the crosspiece 23 by means of an upright bearing bolt 43.

Figure 2:
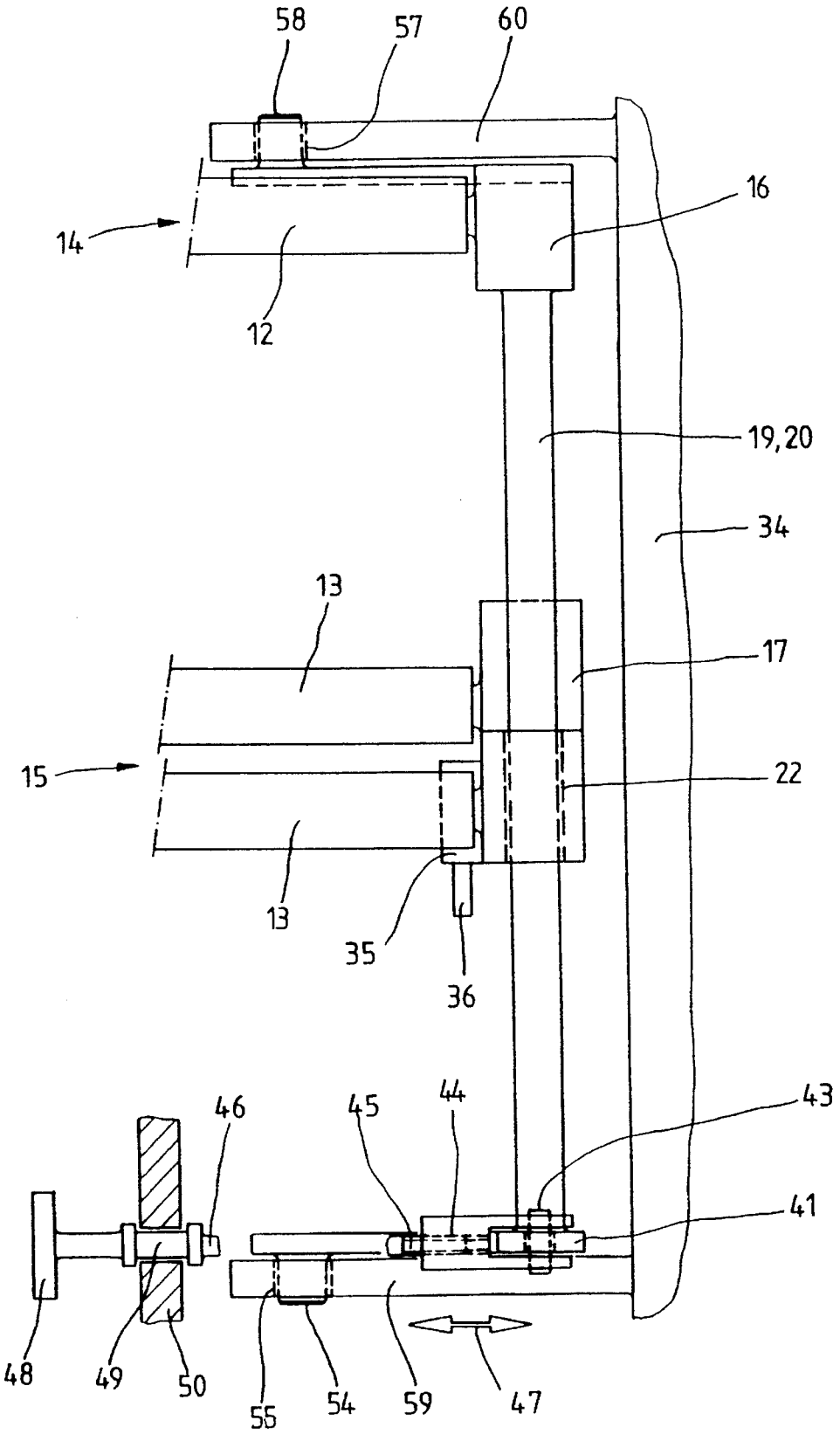
FIG. 2 shows a front view of a modified apparatus according to FIG. 1.

Furthermore, the spindle nut 42 is provided with a threaded bore 44 which interacts with an external screw thread 45 of a spindle rod 46. By rotating the spindle rod 46 about its longitudinal axis, the spindle nut 42 is displaced in the direction of the double arrow 47 in FIG. 2, so that the web of material accumulator 10 is pivoted about the axis of rotation 38.

The pivoting of the web of material accumulator 10 can be effectuated manually or by means of a motor. Manual operation is shown in more detail in FIG. 2. In this case, the spindle rod 46 is provided with a handwheel 48 at its free end. In a region adjacent to the handwheel 48, an axial bearing 49 is arranged, by means of which the spindle rod 46 is rotatably mounted in a holder 50.

An operation by motor is shown in more detail in FIG. 3. In this case, the handwheel 48 is replaced by a servo motor 51. This servo motor 51 is flanged to the spindle rod 46, and connected to the holder 50 with its housing.

An edge sensing member 52 serves for automatically controlling the pivoting movement of the web of material accumulator 10. This edge sensing member 52 may be designed as a so-called forked light barrier, as described in DE 33 41 539 C2. Via a line 53, the edge sensing member 52 is connected to a control device which, on its part, actuates the servo motor 51.

What is claimed is:

1. An apparatus for storing a continuous web (11) of material made from packaging material and having a conveying direction, said apparatus comprising a web accumulator comprising two groups of deflecting rollers which are movable relatively to one another and on which the web of material is guided in loops, wherein each of the deflecting rollers (12, 13) of the web accumulator (10) is rotatable about a respective first axis of rotation which is transverse relative to a longitudinal axis of the web (11) for adjusting the relative position thereof;

wherein the web accumulator (10) is provided with a holder (16) for the first group (14) of deflecting rollers (12), and a carrier (17), which is movable relative to the holder (16), for the second group (15) of deflecting rollers (13), the holder (16) or the carrier (17) being pivotable about a second axis (38) of rotation which is perpendicular relative to said first axes; and wherein the second axis of rotation (38) extends in a central longitudinal plane of the web (11).

2. The apparatus as claimed in claim 1, wherein the second axis of rotation (38) extends in a plane of a first piece of web (39) which runs into the web accumulator (10).

3. The apparatus as claimed in claim 1, wherein the web accumulator (10) is provided with at least two parallel guide rods (19, 20) arranged at a fixed distance from one another, the holder (16) for the first group (14) of deflecting rollers (12) being fixedly arranged on said guide rods (19, 20), and the carrier (17) for the second group (15) of deflecting rollers (13) being slidably arranged in the longitudinal direction of the guide rods (19, 20).

4. The apparatus as claimed in claim 3, wherein the guide rods (19, 20) are fixedly connected to one another by means of the holder (16), at one end, and by means of a crosspiece (23), at the opposite side.

5. The apparatus as claimed in claim 4, wherein the crosspiece (23) and the holder (16) are provided with one transversely directed leg (40, 56) each, which extends up to the region of the second axis of rotation (38), and which is provided with bearing means for pivotably mounting the crosspiece.

6. The apparatus as claimed in claim 5, wherein an actuating member, in the form of a screw drive comprising a spindle rod (46) and a spindle nut (42) for pivoting the web accumulator (10), acts upon the crosspiece (23).

7. The apparatus as claimed in claim 3, having an edge sensing member (52) which is arranged behind, relative to the direction of conveyance of the web of material (11), the web accumuator (10) for determining the relative position of the web of material (11), a servo motor (51) for adjusting the relative position of the web (11) being controllable in accordance to signals of the edge sensing member (11).

8. The apparatus as claimed in claim 3, wherein a shock absorber (36) is arranged on the slideable carrier (17) for buffering a lowering movement of the carrier (17) into a lower position, especially when the web of material (11) tears off.

9. The apparatus as claimed in claim 3, wherein the web of material is assigned sensors (28, 29, 30, 31) for determining the position of the slideable carrier (17), and for controlling the contents of the web accumulator (10), the sensors being arranged on a line extending parallel to the guide rods (19, 20), and each sensor (28 to 31) being assigned to a set position of the slideable carrier (17).

10. An apparatus for storing a continuous web (11) of material made from packaging material and having a longitudinal axis, said apparatus comprising:

a) a web accumulator (10) having a plurality of deflecting rollers (12, 13) which are rotatable around respective first axes, and on which the web of material is guided in loops in a conveying direction;

b) a holder (16) and a slideable carrier (17), the deflecting rollers (12, 13) being arranged in two groups (14, 15), a first group (14) of first deflecting rollers (12) being arranged on the holder (16), and a second group (15) of second deflecting rollers (13) being arranged on the carrier (17);

c) means for moving the carrier (17) and holder (16) relative to one another in a central longitudinal plane so that the carrier and the holder are separated by a distance which is variable, and so that the web of material has a length which is guided in the loops around the deflecting rollers (12, 13), and which increases and decreases, respectively, with increases and decreases in said distance which separates said carrier and said holder; and d) means for pivoting at least one of the first and second groups of deflecting rollers (12, 13) of the material accumulator (10) about a second axis (38) to adjust a relative position of the web of material (11), e) wherein the second axis (38) extends in a central longitudinal plane of the web (11), and transversely relative to said first axes of said first and second deflecting rollers (12, 13).

11. The apparatus as claimed in claim 10, wherein the holder (16) with the first deflecting rollers (12), or the carrier (17) with the second deflecting rollers (13), is pivotable about the rotational axis (38).

12. The apparatus as claimed in claim 10, wherein the web accumulator (10), with the holder (16) and the carrier (17) and with the first and second deflecting rollers (12, 13), respectively, is pivoted about the second axis (38).

13. The apparatus as claimed in claim 10, further comprising means for alternately guiding the web (11) about respective ones of said first deflecting rollers (12) and of said second deflecting rollers (13).

14. The apparatus as claimed in claim 10, wherein the second axis (38) extends in the plane of a first piece (39) of web which runs into the web accumulator (10), and which extends between a rigid deflecting roller (24) and one of said second deflecting rollers (13) that is pivotable about the second axis and arranged downstream of the deflecting roller (24) in said conveying direction.

15. The apparatus as claimed in claim 10, wherein the web accumulator (10) is provided with at least two guide rods (19, 20) which are arranged parallel to and at a fixed longitudinal distance from one another, and on which the holder (16) for the first group (14) of deflecting rollers (12) is fixedly arranged and the carrier (17) for the second group (15) of deflecting rollers (13) is shiftably arranged in the longitudinal direction of the guide rods, and wherein said first axes of said deflecting rollers (12, 13) are directed transversely relative to the guide rods.

16. The apparatus as claimed in claim 15, wherein the guide rods (19, 20) are fixedly connected to one another at one end thereof by the holder (16), and by a crosspiece (23) at an opposite end thereof.

17. The apparatus as claimed in claim 16, wherein the crosspiece (23) and the holder (16) are each provided with a respectively transversely directed leg (40, 56) which extends into a region of the second axis (38) and which is mounted for pivoting about the second axis (38).

18. The apparatus as claimed in claim 15, wherein the web accumulator (10) is assigned sensors (28, 29, 30, 31 ) for determining the position of the slideable carrier (17), the sensors (28 to 31) being arranged parallel to the guide rods (19, 20) at different levels so that each sensor (28 to 31) is assigned to a specific position of the slideable carrier 17.

19. The apparatus as claimed in claim 18, further comprising means for controlling feeding-in of the web of material into the web accumulator and for controlling feeding-out of the web of material from the web accumulator (10).

20. The apparatus as claimed in claim 10, further comprising an actuating member for pivoting the web accumulator (10) about the second axis (38).

21. The apparatus as claimed in claim 20, further comprising an edge sensing member (52) arranged downstream of the web accumulator (10) in the conveying direction for determining the relative position of the web of material (11) and for controlling the actuating member in accordance with signals from the edge sensing member (52).

22. The apparatus as claimed in claim 20, wherein the actuating member (39) is provided with a servo motor (51) and a spindle drive that is connected to the pivotable web accumulator (10), the spindle drive being comprised of a spindle rod (46) and a spindle nut (42).

23. The apparatus as claimed in claim 10, further comprising a shock absorber (35) on the slideable carrier (17) for buffering a lowering movement of the carrier (17) into a lower position when the web of material (11) tears off.

* * * * *